United States Patent [19]

Kurataro

[11] 4,071,915

[45] Feb. 7, 1978

[54] WATER CLOSET SEAT WARMER AND VENTILATOR

[76] Inventor: Kuze Kurataro, No. 37-5, 1-chome, Sasazuka, Shibuya, Tokyo, Japan

[21] Appl. No.: 714,836

[22] Filed: Aug. 16, 1976

[30] Foreign Application Priority Data

Jan. 9, 1975 Japan ..... 50-105010

[51] Int. Cl.[2] ..... E03O 9/04; A47K 13/00

[52] U.S. Cl. ..... 4/217; 4/DIG. 6

[58] Field of Search ..... 4/209, 213, 216, 217, 4/DIG. 6, 233

[56] References Cited

U.S. PATENT DOCUMENTS

| | | | |
|---|---|---|---|
| 929,079 | 7/1909 | Cresse | 4/DIG. 6 |
| 1,839,156 | 12/1931 | Lumpkin | 4/DIG. 6 |
| 2,172,506 | 9/1939 | Gerger | 4/217 |
| 2,240,094 | 4/1941 | Foreman | 4/217 |
| 2,849,727 | 9/1958 | Bollinger et al. | 4/217 |
| 2,875,450 | 3/1959 | Umann | 4/DIG. 6 |
| 3,154,793 | 11/1964 | Congdon | 4/DIG. 6 |
| 3,594,826 | 7/1971 | Maurer | 4/7 |
| 3,953,901 | 5/1976 | Poister et al. | 4/217 |

*Primary Examiner*—Richard E. Aegerter
*Assistant Examiner*—Stuart S. Levy
*Attorney, Agent, or Firm*—Holman & Stern

[57] ABSTRACT

The water closet seat is provided with long holes for blowing hot air, and the hot air is blown to the long holes by means of an air heater which heats air and supplys hot air to heat the closet seat for a short time or to keep the closet seat warm, and the water closet seat is provided with offensive odor guiding long holes and is provided with a plurality of offensive odor suction ports which are directed from the long holes for guiding offensive odor towards the water closet seat, and the offensive odor is sucked into the offensive odor guiding long holes at a close distance from the filth by means of the suction force of a ventilator, and the hot air blowing long holes and offensive odor guiding long holes are mutually communicated and the offensive odor and the used hot air passing through the hot air blowing long holes are exhausted outside by means of the ventilator, and thus objects of keeping the closet seat warm and of exhausting the offensive odor in the lavatory can be achieved.

1 Claim, 9 Drawing Figures

WATER CLOSET SEAT WARMER AND VENTILATOR

BACKGROUND OF THE INVENTION

The present invention relates to a water closet, and more particularly to a water closet provided with a heating device and an offensive odor exhausting device.

Heretofore, as the heating device for closet seat of the water closet in winter time, a technique of installing nickel chromium wire in the closet seat and heating the closet seat with the electric heating has been employed, but this technique has a drawback that the closet seat cannot be heated in extremely short time. Moreover, in discharging the filth on account of physiological requirement of human being, the offensive odor filled in the lavatory is exhausted outside physically by means of a ventilating fan mounted on the ceiling or wall in the lavatory or the offensive odor is exhausted outside by merely opening the window of the lavatory to replace it with fresh air naturally. However, originally, as the offensive odor in the lavatory occurs during the discharge of the filth and yet it occurs in the water closet itself and its periphery, it is not possible to exhaust the offensive odor outside the lavatory in extremely speedy manner by the conventional technique, and an object of keeping the offensive odor off the lavatory cannot be sufficiently achieved.

The present invention has succeeded in solving the conventional problems almost completely.

SUMMARY OF THE INVENTION

An object of the present invention is to provide a water closet wherein hot air is blown to the closet seat of the water closet by means of an air heater and thus the closet seat is heated in short time and is kept warm.

Another object of the present invention is to provide a water closet wherein offensive odor in close distance of the filth is sucked by means of a ventilator from a plurality of offensive odor suction ports provided on the closet seat, and the offensive odor together with the used hot air is exhausted outside so that the offensive odor filled in the lavatory is exhausted rapidly in extremely short time.

A still another object of the present invention is to provide a water closet wherein the heating device and the offensive odor sucking exhausting device according to the present invention can be simply mounted on the conventional water closet without particularly modifying thereof.

DETAILED DESCRIPTION OF THE INVENTION

Figure 1:
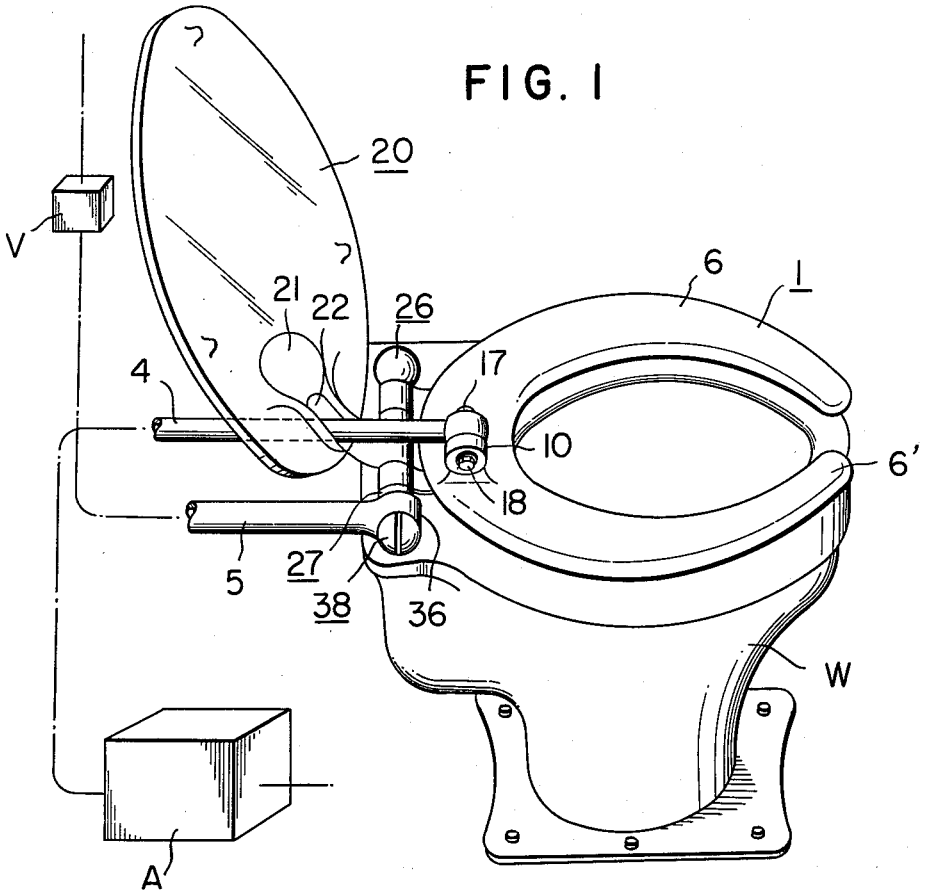
FIG. 1 is a perspective view of the water closet in its entirety, and the air heater and ventilator are indicated by sketch.
Figure 2:
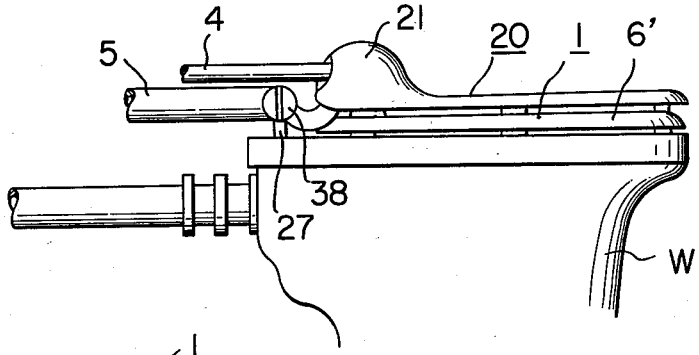
FIG. 2 is a side view showing the water closet with the cover being closed.
Figure 3:
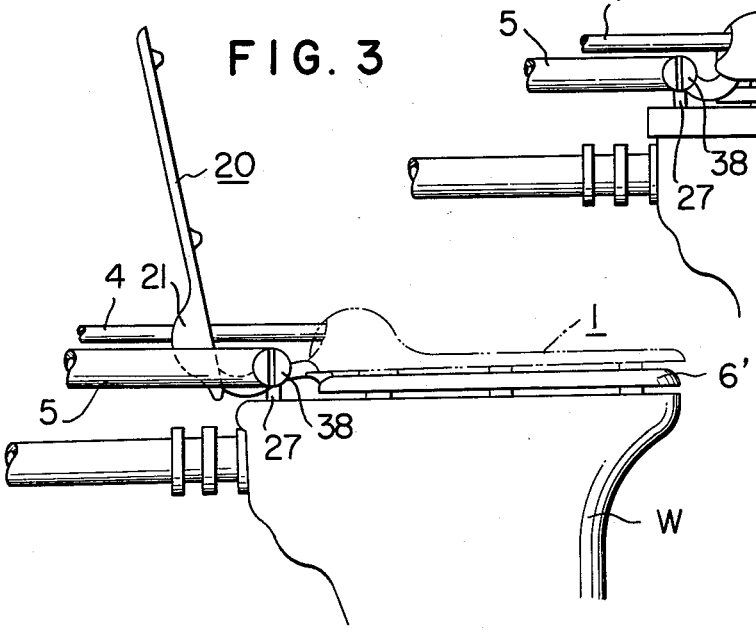
FIG. 3 is a side view showing the water closet with the cover being opened.
Figure 4:
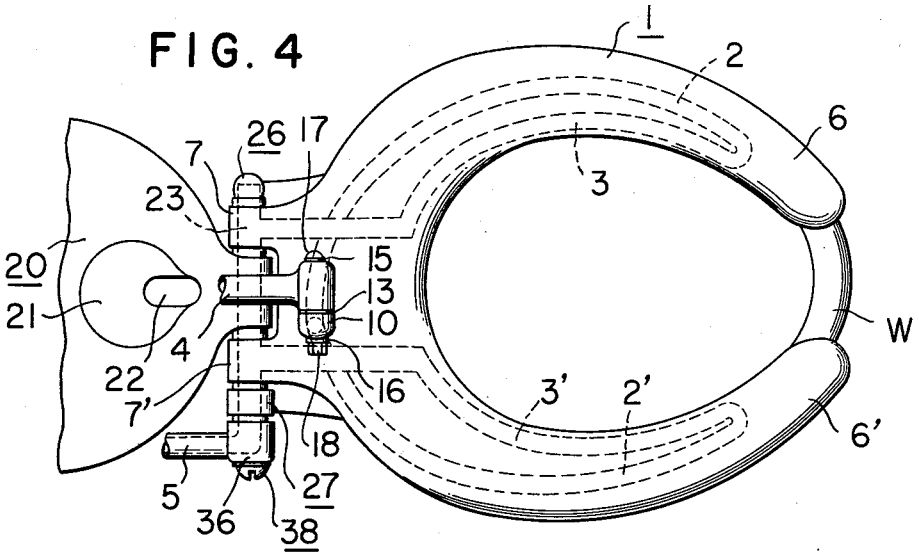
FIG. 4 is a plan view showing the water closet with the cover being opened.
Figure 5:
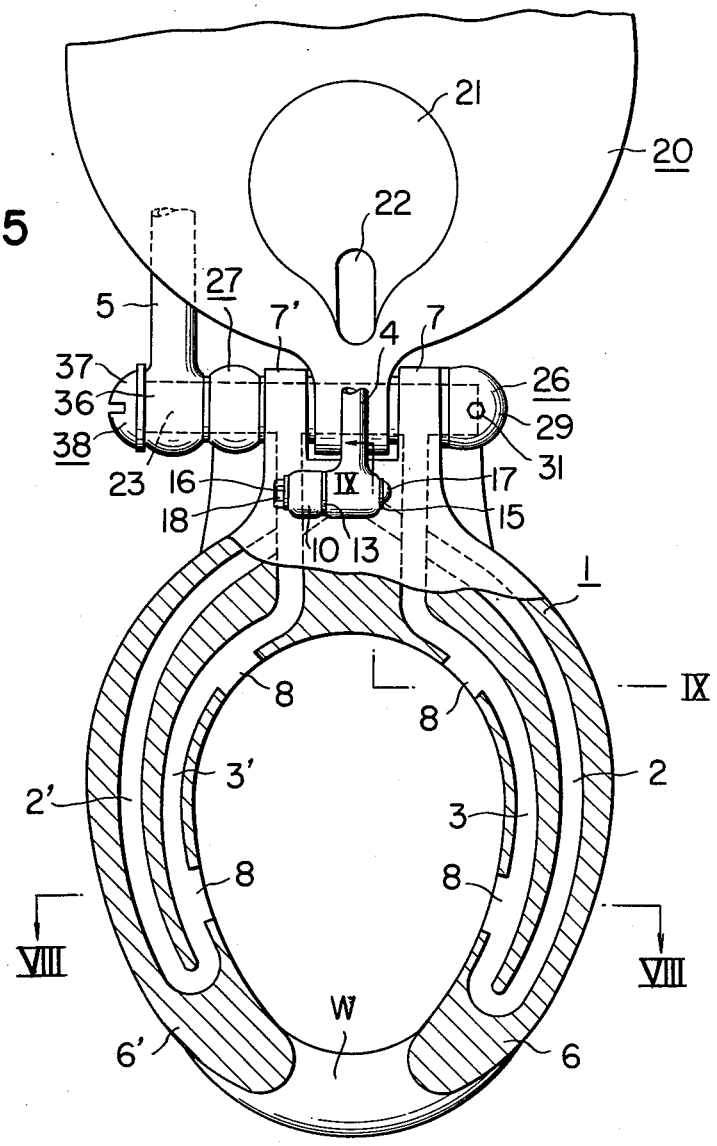
FIG. 5 is an enlarged plan view showing its part in cross section wherein the cover of the water closet is opened.
Figure 6:
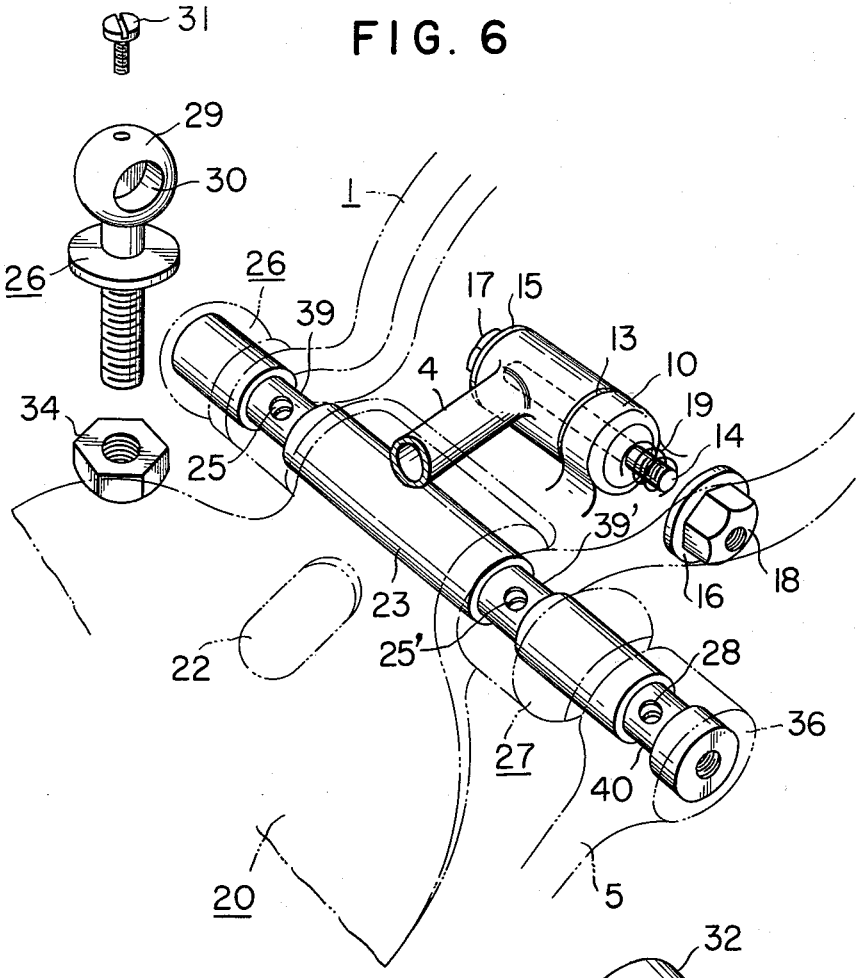
FIG. 6 is an enlarged decomposed perspective view showing the mounted condition of the pivot and air blowing pipe.
Figure 9:
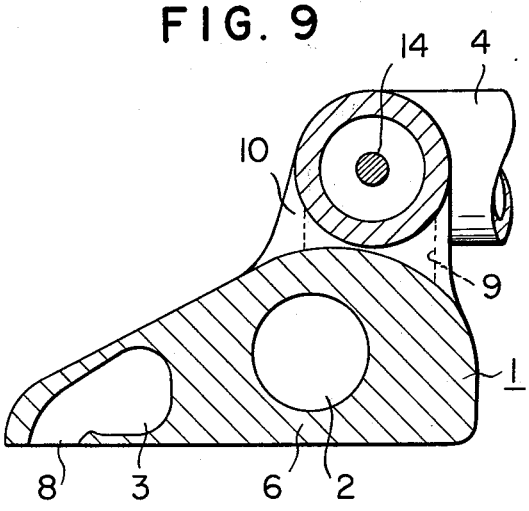
FIG. 9 is an enlarged cross section taken along a line IX—IX in FIG. 5.
Figure 9:
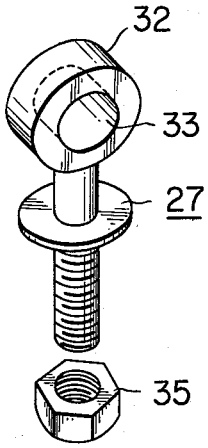

The water closet according to the present invention is composed of a water closet pan which is generally indicated by normal letter W, an air heater A which heats air and supplies hot air and is separately installed on the water closet pan W and a ventilator V are indicated by sketch, and the closet seat 1 is provided with hot air blowing long holes 2, 2' and offensive odor guiding long holes, 3, 3', and connecting means is provided for connecting an air blowing pipe 4 extended from the air heater A to the hot air blowing long holes 2, 2', and connecting means is provided for connecting an exhaust pipe 5 extended from the ventilator V to the offensive odor guiding long holes 3, 3'.

The hot air blowing long holes 2, 2' are extended in the vicinity of the tip of each wing 6, 6' passing the inside of both wings 6, 6' from the rear position of the closet seat 1, and the offensive odor guiding long holes 3, 3' are extended to reach the tip passing the inside of both wings 6, 6' of the closet seat 1 while said holes are in parallel with the hot air blowing long holes, 2, 2' from the right and left mounting portions 7, 7' of the closet seat, and the hot air blowing long holes 2, 2' and the offensive odor guiding long holes 3, 3' are communicated mutually at each tip portion of both - wings 6, 6' of the closet seat 1, and the offensive odor guiding long holes 3, 3' are provided with a plurality of offensive odor suction ports 8 for sucking the offensive odor at the extreme close distance of the filth which are directed towards the inner part of the water closet pan W.

Figure 7:
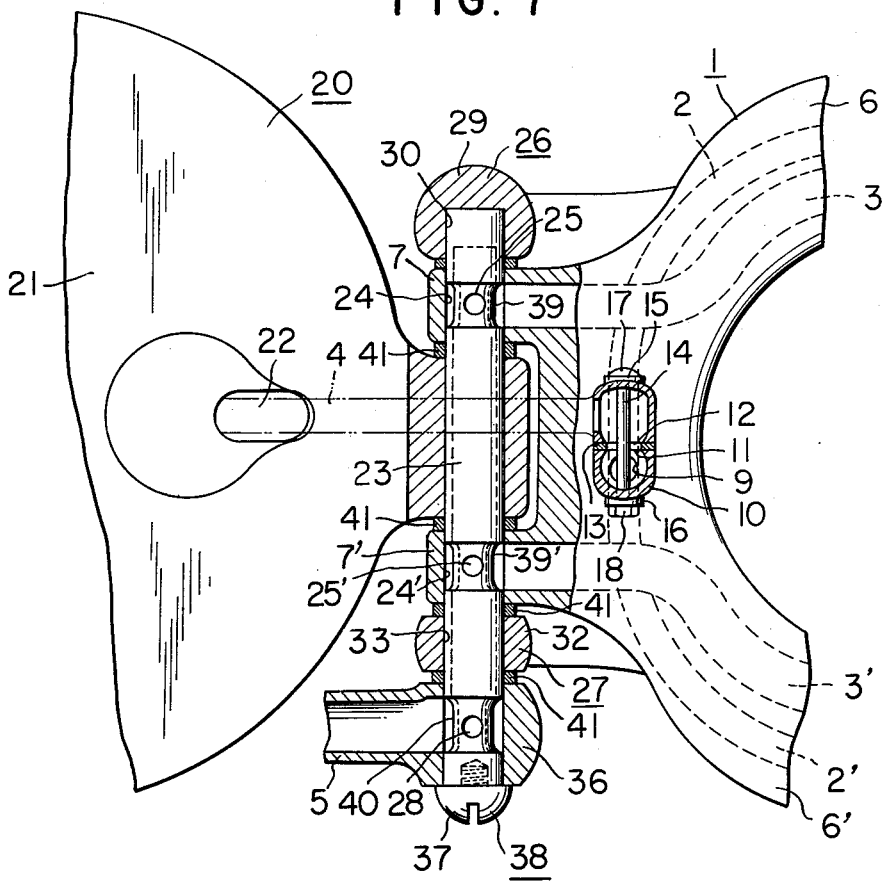
FIG. 7 is an enlarged plan view of an essential part showing its part in cross section at the mounting portion of the cover and the closet seat.
Figure 8:
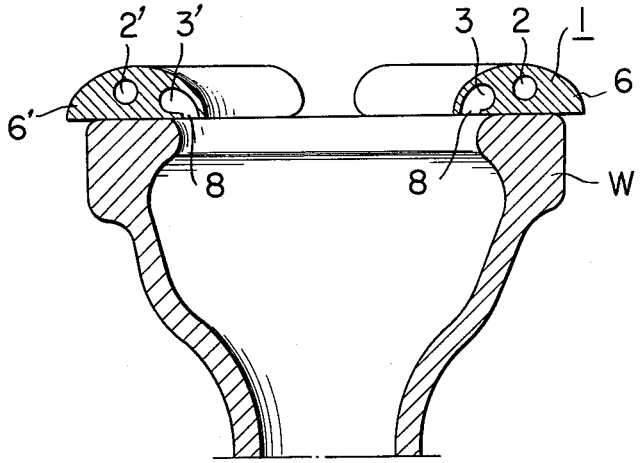
FIG. 8 is a cross section taken along a line VIII—VIII in FIG. 5.

The connecting means of the air blowing pipe 4 extended from the air heater A communicates the hot air blowing long holes 2, 2' provided on both wings 6, 6' which are located at the rear position of the closet seat 1, and an air blowing hole 9 communicated with the upper surface of the closet seat 1 is provided, and this air blowing hole 9 is communicated with a short cylinder 10 which is raised perpendicularly integrally with the upper surface of the closet seat 1. The short cylinder 10 is provided with an opening portion 11 at the position of the side of the upper part so that the short cylinder 10 is positioned in transversal direction, and an opening portion 12 is provided at the position of the side of the tip of the air blowing pipe 4 so that the opening portion 12 is positioned in transversal direction, and the opening portion 12 of the air blowing pipe 4 and the opening portion 11 of the short cyinder 10 are connected by interposing a packing 13. And the air blowing pipe 4 and the short cylinder 10 are clamped and connected by means of the bolt 14 as shown in FIG. 7 by screwing nuts 17, 18 with the mounting of packings 15, 16 having function of washer and function of preventing offensive odor leakage on both end portions of the bolt 14. The opening portions 11, 12 are contacted tightly resiliently by interposing a spring 19 between the packing 16 and nut 18 at one end side of the bolt 14, and the closet seat 1 can be swung freely in the vertical direction.

A bulged portion 21 is provided on the cover 20 which covers the connecting means including the short cylinder 10 and the part of the air blowing pipe 4 connected to said short cylinder 10 when it is closed, and a hole 22 for allowing the air blowing pipe 4 to run through is formed on the cover 20, and the opening/-closing of the cover can be made without being interrupted by the connecting portion and the air blowing pipe 4. The hole 22 provided on the cover 20 must be formed longitudinally to the size allowing the free opening/closing of the cover 20 only when the closet seat 1 is located at the set position as shown in FIG. 1 to the water closet pan W.

The connecting means for connecting the offensive odor guiding long holes 3, 3' and the exhaust pipe 5 extended from the ventilator V is formed in such a way that the pivot 23 for connecting the closet seat 1 and the cover 20 to the water closet pan W is formed as the hollow pipe whose both ends are closed, and the offensive odor guiding long holes 3, 3' provided on the wings 6, 6' of the closet seat 1 are extended to the axial holes 24, 24' of the mounting portions 7, 7' of the closet seat 1, and are made to penetrate therethrough, and the offensive odor guiding long holes 3, 3' are communicated with the inside of the pivot 23 by means of the through holes 25, 25' formed on the pivot 23. Both ends of the pivot 23 are extended and projected outward of the mounting portions 7, 7' of both sides of the closet seat 1, and in order to prevent the pivot 23 from rotating, the pivot 23 is fixed by means of the support bolts 26, 27 mounted on the water closet pan W at both sides of the pivot 23, and one end side of the pivot 23 is extended and projected further outward of the support bolt 27, and is connected to the exhaust pipe 5 extended from the ventilator V, and the inside of the pivot 23 and the exhaust pipe 5 are communicated by means of the through hole 28 provided on the pivot 23. With this communication, the offensive odor guiding long holes 3, 3' are communicated with the exhaust pipe 5 of the ventilator V by means of the pivot 23.

The support bolt 26 is fitted to one end of the pivot 23 through a circular concave portion 30 formed on the side of the head portion 29, and the bolt and the shaft are fixed by means of the bolt 31. The other bolt 27 is fitted to the other end of the pivot 23 through a through hole 33 formed on the side of the head portion 32. The support bolts 26, 27 are inserted through the rear portion of the water closet pan W, and nuts 34, 35 are screwed to fix the support bolts 26, 27 to the water closet pan W.

The exhaust pipe 5 is provided with a cylindrical cap 36 whose tip is directed in right angle direction, and the cylindrical cap 36 is fitted to the other end of the pivot 23. A bolt 38 provided with a heat portion 37 whose diameter is larger than that of the pivot 23 is screwed to the tip surface of the pivot 23, and the cylindrical cap 36 is fitted to the tip portion of the pivot 23.

The pivot 23 is provided with annular concave grooves 39, 39' at the positions of through holes 25, 25' connected to the offensive odor guiding long holes 3, 3', and when the closet seat 1 is manipulated, the offensive odor guiding long holes, 3, 3' can be communicated with the inside of the pivot 23 at any position. The pivot 23 is provided with an annular concave groove 40 at the position of the through hole 28 communicating with the exhaust pipe 5 so that the exhaust pipe 5 can be communicated with the inside of the pivot 23 notwithstanding the angular position of the exhaust pipe 5. These annular concave grooves 39, 39' and 40 are provided with packings 41 so as to be sealed.

Accordingly, the water closet according to the present invention facilitates the comfortable use of the closet seat 1 in winter season as the hot air blown from the air heater A through the air blowing pipe 4 is supplied to the hot air blowing long holes 2, 2' through the air blowing hole 9 provided on the short cylinder 10, and said hot air heats the closet seat 1 rapidly and keeps it warm. Moreover, the water closet according to the present invention has features that the offensive odor is sucked through a plurality of offensive odor suction ports 8 at the close distance of the filth in the water closet pan W in forced manner, and the offensive odor is led to the exhaust pipe 5 through the inside of the pivot 23 from the offensive odor guiding long holes 3, 3', and the offensive odor together with the used hot air passing the hot air blowing long holes 2, 2' of the closet seat 1 are forcedly exhausted outside by means of the ventilator, and thus its function of exhausting the offensive odor is extremely rapid and effective, whereby the offensive odor is seldom diffused by the hot air in the lavatory. In the seasons other than winter, only the exhaustion of the offensive odor can be carried out by stopping the operation of the air heater A.

Furthermore, as the opening portion 12 of the air blowing pipe 4 and the opening portion 11 of the short cylinder 10 are connected resiliently so as to be sealed by interposing the spring 19 on the bolt 14, the water closet pan W does not interfere with the manipulation of vertical movement of the closet seat 1. As the through holes 25, 25' communicated with the offensive odor guiding long holes 3, 3' are arranged to be communicated with the offensive odor guiding long holes 3, 3' through the annular concave grooves 39, 39' formed on the outer periphery of the pivot 23, the through holes 25, 25' assure the communication always regardless of positions of the closet seat 1 when swung in any angle, and thus the offensive odor and the used hot air can be sucked and led out to the exhaust pipe 5 completely, and accordingly, the offensive odor which is the most disgustful in the lavatory can be exhausted outside whereby the object of exhausting the offensive odor can be sufficiently achieved.

Furthermore, it is possible to mount the present invention on the installed water closet by merely replacing the conventional ones with the closet seat 1 and the pivot 23 according to the present invention.

What is claimed is:

1. A water closet comprising a closet chamber and a closet seat having wings, said wings having front tip portions and rear portions, said rear portions joined together forming an integral closet seat, said water closet further including right and left mounting means for attaching the rear portion of said wings to said closet chamber, said water closet also including a cover for said closet seat, said mounting means pivotally mounting said cover thereupon, said improvement comprising:

a warm air source;

a vacuum source;

suction passageway means for connecting a plurality of suction ports along said wings, between said tip and said rear portions, with said mounting means;

suction connecting means for connecting, through said mounting means, said suction passageway means with said vacuum source;

closet seat warming means comprising at least one passageway in each wing, from the rear portion of the wing to the front tip thereof, said passageway connected to said suction passageway means at said tip; and warm connection means for connecting said seat warming means with said warm air source, said warm connection means comprising a pivotal connection between said warm air source and said seat warming means permitting the flow of warm air therethrough regardless of the position of said seat allowing said seat to be quickly warmed while at the same time conducting odors and foul air associated therewith from said water closet chamber through said suction ports and into said vacuum source.

* * * * *